US005408937A

United States Patent [19]

Knight, IV et al.

[11] Patent Number: 5,408,937

[45] Date of Patent: Apr. 25, 1995

[54] VENTILATED PALLET

[75] Inventors: John W. Knight, IV, New Concord; Paul W. Baker, Cambridge; Donald J. Dietsch, Byesville, all of Ohio

[73] Assignee: The Fabri-Form Co., Byesville, Ohio

[21] Appl. No.: 988,811

[22] Filed: Dec. 10, 1992

[51] Int. Cl.[6] ..... B65D 19/38

[52] U.S. Cl. ..... 108/55.5; 108/53.3; 108/55.1; 108/901

[58] Field of Search ..... 108/901, 55.5, 51.1, 108/53.3, 53.1

[56] References Cited

U.S. PATENT DOCUMENTS

| | | | |
|---|---|---|---|
| Re. 32,344 | 3/1987 | Wind | 206/599 |
| 2,486,284 | 4/1946 | Horwitz | 248/120 |
| 2,634,932 | 4/1953 | Withers | 108/51.1 |
| 2,918,190 | 7/1954 | Martin | 220/4 |
| 2,950,078 | 8/1960 | Phillips | 248/120 |
| 2,973,931 | 3/1961 | Brown | 245/120 |
| 3,145,870 | 8/1964 | Lockwood | 220/4 |
| 3,187,691 | 6/1965 | Leitzel | 108/58 |
| 3,346,137 | 10/1967 | Ricci | 220/23.6 |
| 3,371,816 | 3/1968 | Ricci | 220/4 |
| 3,467,032 | 9/1969 | Rowlands et al. | 108/51 |
| 3,524,415 | 8/1970 | Heiman | 108/53 |
| 3,526,195 | 9/1970 | Maryenovich | 108/53 |
| 3,561,375 | 9/1971 | Hammond | 108/53 |
| 3,610,173 | 10/1971 | McIlwraith | 108/57 |
| 3,636,888 | 1/1972 | Angelbeck, Jr. | 108/51 |
| 3,664,271 | 5/1972 | Wolder et al. | 108/51 |
| 3,664,570 | 5/1972 | Kupersmit | 229/23 |
| 3,667,403 | 6/1972 | Angelbeck, Jr. | 108/58 |
| 3,680,495 | 8/1972 | Pike | 108/901 |
| 3,680,496 | 8/1972 | Westlake, Jr. | 108/58 |
| 3,696,761 | 10/1972 | Brown | 108/53 |

(List continued on next page.)

FOREIGN PATENT DOCUMENTS

| | | |
|---|---|---|
| 2165676 | 7/1973 | Germany . |
| 2535681 | 2/1977 | Germany . |
| 2651929 | 5/1978 | Germany . |
| 2909541 | 9/1980 | Germany . |

OTHER PUBLICATIONS

Advertisement from PRO-FORM Germantown, Wis. (2 pages).

Advertisement from Global Equipment Co. (1 page).

Front Cover of Aug. 31, 1992, Chemical & Engineering News (1 page).

Advertisement from Litco International Inc., Vienna, Ohio, Showing Inca Pallet (4 pages).

Advertisement from Tuscarora Container System, Pa. (1 page).

Advertisement from United States Corrulite Corporation, Clewiston, Fla. (1 page).

*Primary Examiner*—Michael J. Milano

*Attorney, Agent, or Firm*—Renner, Kenner, Greive, Bobak, Taylor & Weber

[57] ABSTRACT

A pallet (10)for use in bearing a load from material requiring a circulation of air during storage or shipment thereof, includes a thermoformed plastic body (11) have a plurality of ventilation apertures (30,31) therethrough, and a plurality of strengthening grooves (32, 40, 50) integrally formed in the body (11) and juxtaposed to the ventilation apertures (30,31). In use, the pallet (10) may carry a container (14) thereon and the material is contained within the container (14). The container (14) includes at least two opposing walls (52) and at least one aperture (53) in each of two opposing walls (52). The pallet (10) includes a plurality of downwardly extending feet (10, 21, 22, 23) to raise the pallet (10). At least one of the apertures (53) of the container (14) generally aligns with at least one of the ventilation apertures (30, 31) of the pallet (10) when the container (14) is stacked on the pallet (10).

6 Claims, 7 Drawing Sheets

U.S. PATENT DOCUMENTS

| | | | |
|---|---|---|---|
| 3,699,901 | 10/1972 | Cook, III | 108/58 |
| 3,702,100 | 11/1972 | Wharton | 108/901 |
| 3,707,127 | 12/1972 | Palfey | 108/53 |
| 3,719,157 | 3/1973 | Arcocha et al. | 108/51 |
| 3,732,955 | 9/1974 | Pottinger et al. | 108/51 |
| 3,750,596 | 8/1973 | Box | 108/43 |
| 3,757,704 | 9/1973 | Allgeyer et al. | 108/51 |
| 3,768,423 | 10/1973 | Cook, III et al. | 108/51 |
| 3,776,145 | 12/1973 | Anderson et al. | 108/51 |
| 3,868,915 | 3/1975 | Hafner | 108/51 |
| 3,944,070 | 3/1976 | Cardwall et al. | 206/386 |
| 3,948,190 | 4/1976 | Cook, III et al. | 108/53 |
| 3,968,895 | 7/1976 | Barnes, Jr. et al. | 220/1.5 |
| 3,993,168 | 11/1976 | Kubick | 108/53 |
| 4,000,704 | 1/1977 | Griffin, Jr. | 108/53.1 |
| 4,013,020 | 3/1977 | Schoeller et al. | 108/51.1 |
| 4,015,544 | 4/1977 | Szatkowski | 108/51.3 |
| 4,042,107 | 8/1977 | Kendig | 206/386 |
| 4,254,873 | 3/1981 | Cook, III et al. | 206/599 |
| 4,279,204 | 7/1981 | Propst | 108/53.3 |
| 4,290,369 | 9/1981 | Propst et al. | 108/53.3 |
| 4,372,028 | 2/1983 | Clark et al. | 29/460 |
| 4,397,247 | 8/1983 | Lemelson | 108/57.1 |
| 4,403,555 | 9/1983 | Forrest | 108/51.1 |
| 4,413,737 | 11/1983 | Wind | 206/599 |
| 4,428,306 | 1/1984 | Dresen et al. | 108/53.3 |
| 4,550,830 | 11/1985 | Shuert | 206/386 |
| 4,606,278 | 8/1986 | Shuert | 108/51.1 |
| 4,674,414 | 6/1987 | Nülle et al. | 108/901 |
| 4,742,781 | 5/1988 | Shuert | 108/53.3 |
| 4,765,252 | 8/1988 | Shuert | 108/55.1 |
| 4,809,618 | 3/1989 | Bell | 108/901 |
| 4,815,394 | 3/1989 | Ettlinger et al. | 108/901 |
| 4,856,657 | 8/1989 | Shuert | 206/600 |
| 4,879,956 | 11/1989 | Shuert | 108/53.3 |
| 4,936,451 | 6/1990 | Shuert | 206/386 |
| 4,947,988 | 5/1990 | Schutz | 206/386 |
| 4,962,692 | 10/1990 | Shuert | 98/41.2 |
| 4,976,092 | 12/1990 | Shuert | 83/475 |
| 4,989,731 | 2/1991 | Shuert | 206/386 |
| 5,042,396 | 8/1991 | Shuert | 108/51.1 |
| 5,108,529 | 4/1992 | Shuert | 156/214 |
| 5,117,762 | 6/1992 | Shuert | 108/51.1 |
| 5,168,817 | 12/1992 | Nulle et al. | 108/51.1 |

VENTILATED PALLET

TECHNICAL FIELD

The present invention is directed toward a pallet useful with materials requiring a circulation of air during storage and shipment. More particularly, the present invention is directed toward a pallet which is ventilated in order to facilitate the circulation of air about the materials. Specifically, the present invention provides a ventilated pallet which permits circulation of air about the materials stored thereon, and which possess an inherent strength substantially similar to the strength normally associated with conventional, non-ventilated pallets.

BACKGROUND ART

Pallets are load bearing structures used to provide a stable platform for the storage, transportation or shipment of materials. The materials are often strapped or bound, packaged or otherwise contained in boxes or the like, which are then stacked onto the pallet.

It is known to provide pallets with feet or other structures to raise the pallet off of a support surface such as the ground, in order to allow a forklift blade to move under the pallet and to lift the entire load. While the pallets are often made of wood, it is desirable to thermoform plastic pallets. Such plastic pallets are often stronger, less expensive and less susceptible to degradation caused by weathering or the like, than their wooden counterparts. Structures such as the feet, strengthening grooves and other components, may be formed in the pallet during the thermoforming operation.

In some instances, the materials to be transported using a pallet require a free-flow or circulation of air or air laden stabilizers, fresheners, insecticides, anti-bacterial agents or the like, during the time that the materials are stacked thereon.

For example, pallets are often employed in the storage and shipment of fruits and vegetables. These materials may be placed in boxes with holes cut therein to allow air to circulate through the box. Such operations help to minimize rot, premature ripening or even insufficient ripening, and the like.

Plastic, thermoformed pallets will normally not allow air to pass therethrough. Thus, the circulation of air is curtailed from the bottom of a stack of materials on the given pallet. One suggestion has been to provide the pallet with air holes to allow such circulation. This practice has not heretofore been successfully implemented. A hole in a pallet will lessen the pallet's inherent strength at that point and adjacent surrounding points. The strength of a pallet is, of course, of utmost concern to its functionality and longevity. A loss in strength will decrease the overall usefulness of the pallet.

A need exists therefore, for a pallet which is able to allow sufficient air circulation for materials stacked thereon, yet which maintains an inherent strength sufficient to accomplish its intended load bearing task.

DISCLOSURE OF THE INVENTION

It is therefore, an object of the invention to provide a pallet for use with materials requiring a circulation of air during storage or shipment thereof.

It is another object of the invention to provide a pallet, as above, which will possess sufficient load bearing strength to support the materials during storage or shipment.

At least one or more of the foregoing objects, together with the advantages thereof over the known art relating to pallets, which shall become apparent from the specification which follows, are accomplished by the invention as hereinafter described and claimed.

In general, the present invention provides a pallet for use in bearing a load from material requiring a circulation of air during storage or shipment thereof. The pallet includes a thermoformed, plastic body having a plurality of ventilation apertures therethrough, and a plurality of strengthening grooves integrally formed in the body adjacent to the ventilation apertures.

The material is housed within a container which includes at least two opposing walls and at least one aperture in each of the opposing walls. The body of the pallet is raised off the ground or support surface by a plurality of feet extending downwardly from the pallet body. One of the apertures in the opposing walls of the container generally aligns with one of the ventilation apertures of the pallet when the container is stacked on the pallet.

PREFERRED EMBODIMENT FOR CARRYING OUT THE INVENTION

Figure 2:
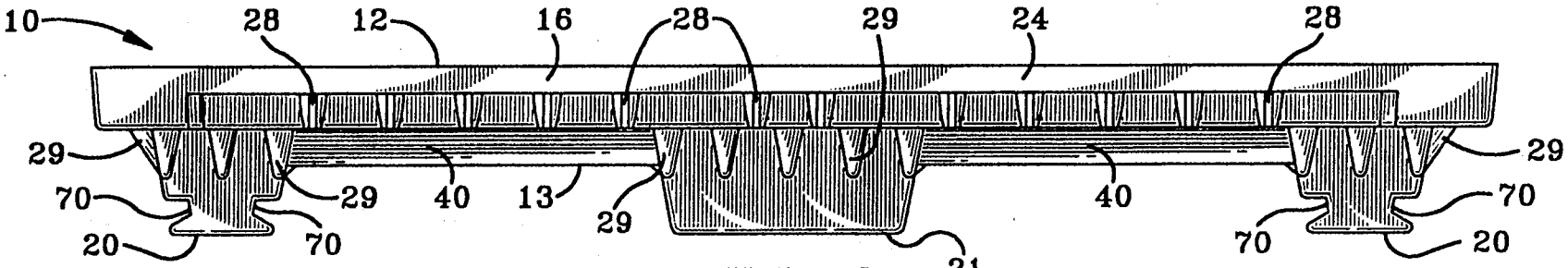
FIG. 2 is a side elevational view taken along line 2—2 of FIG. 1.
Figure 3:
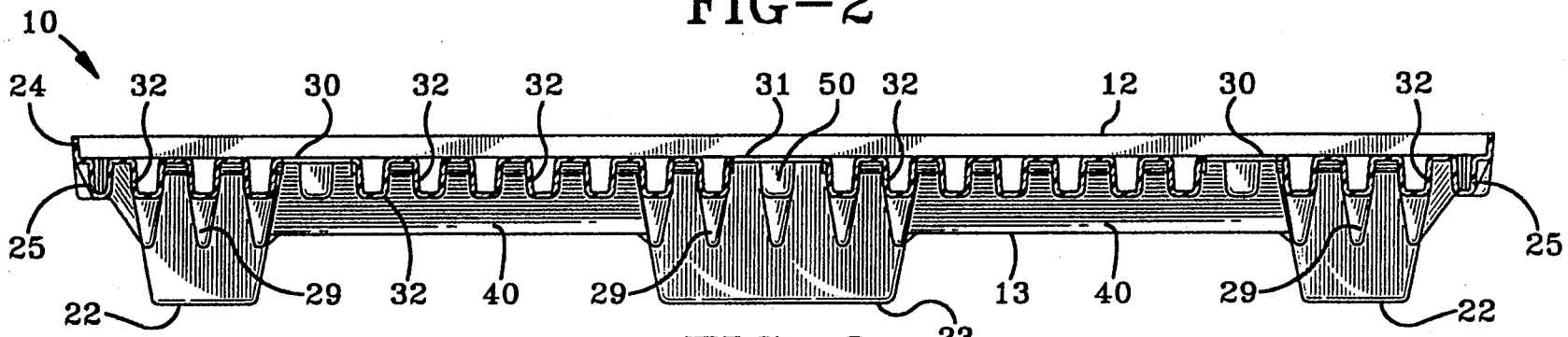
FIG. 3 is a sectional view taken substantially along line 3—3 of FIG. 1.
Figure 4:
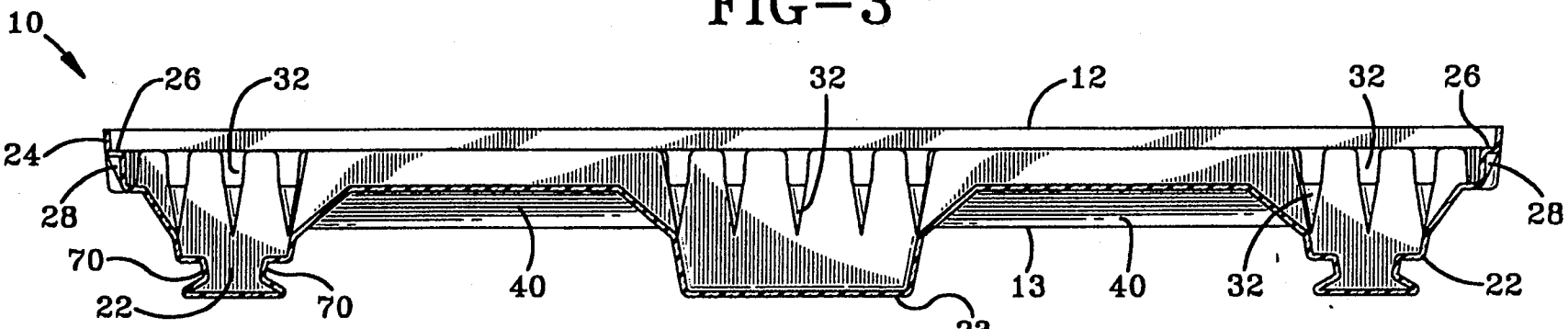
FIG. 4 is a sectional view taken substantially along line 4—4 of FIG. 1.
Figure 9:
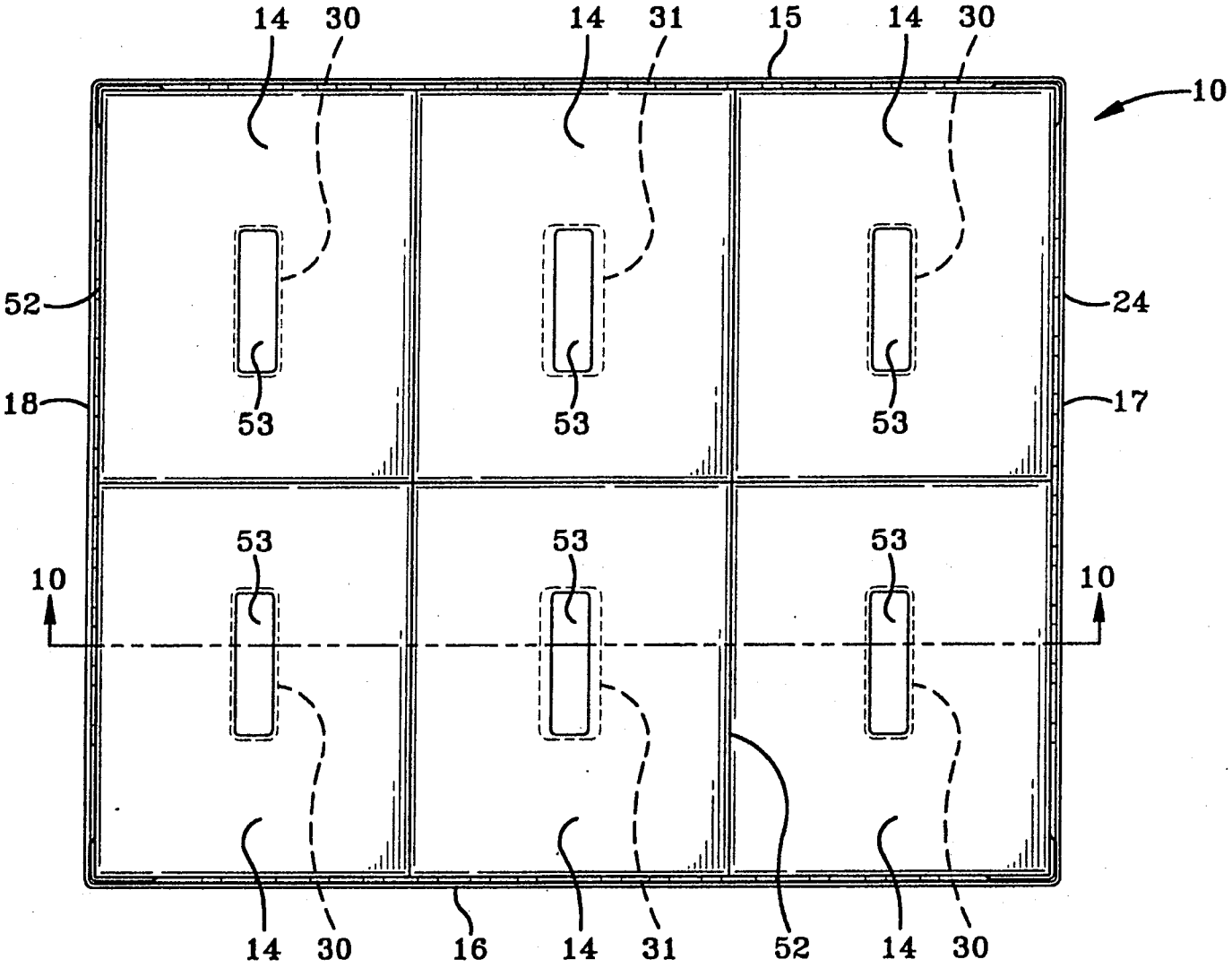
FIG. 9 is a top plan view of the pallet of FIG. 1, with an exemplary embodiment of storage containers stacked thereon.
Figure 10:
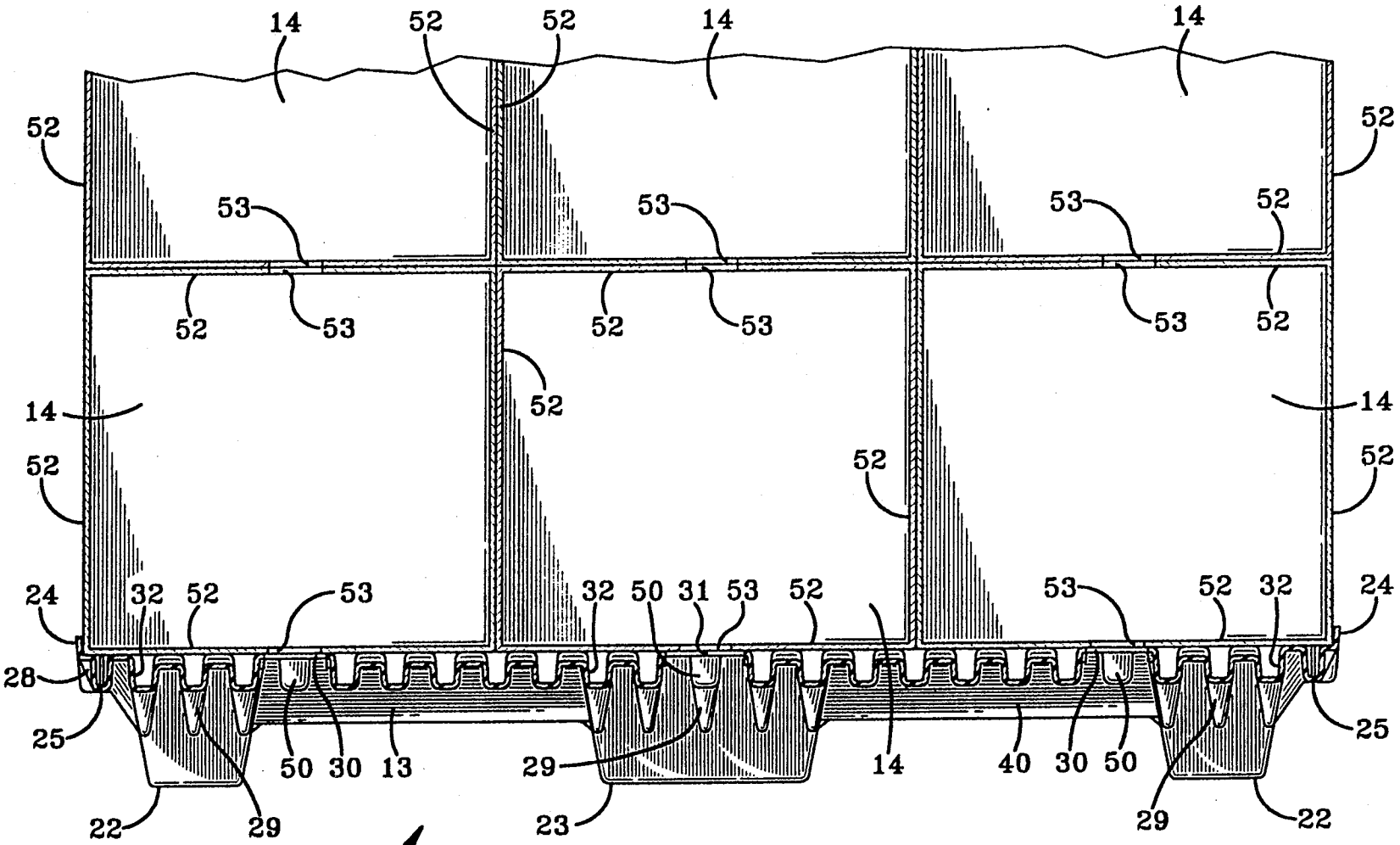
FIG. 10 is a fragmented sectional view taken substantially along line 10—10 of FIG. 9.

A pallet embodying the concepts of the present invention is generally indicated by the numeral 10 in the drawings and is preferably generally rectilinear having a body 11 which includes a generally polygonal upper surface 12 and a corresponding generally polygonal lower surface 13 (FIG. 2). Pallet 10 may be formed in any conventional manner, such as by being thermoformed from a single-ply of plastic, such as high density polyethylene, or other suitable material. Multi-ply or multi-wall pallets are also within the scope of the invention. Pallet 10 may be employed as a load bearing surface for material (not shown) which may be contained in containers such as boxes 14 stored thereon (FIGS. 9 and 10). The cooperation between pallet 10 and certain boxes 14 according to the invention, will be further discussed hereinbelow.

Figure 1:
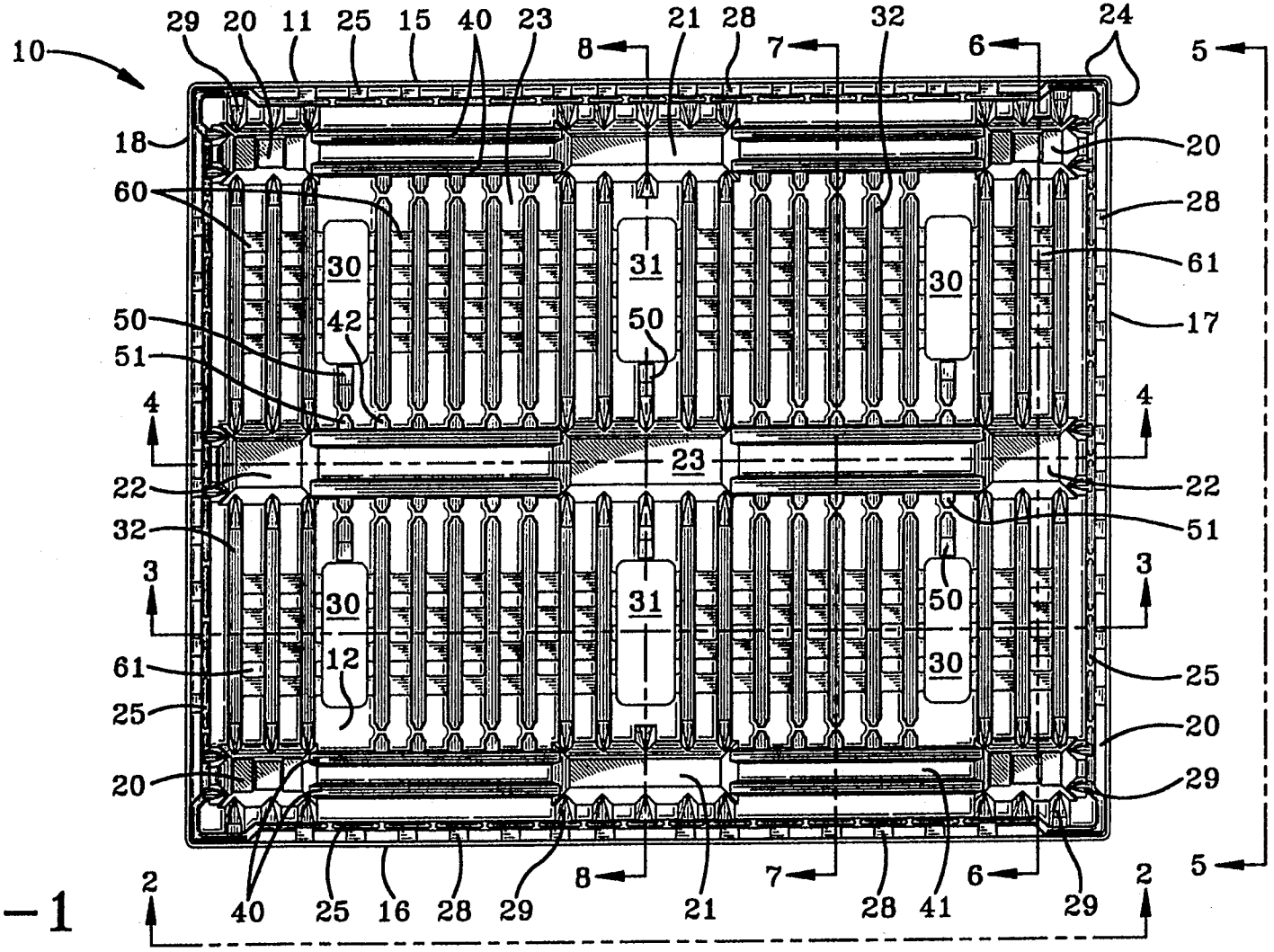
FIG. 1 is a top plan view of a pallet embodying the concepts of the present invention.

Pallet 10 is shown as being generally rectangular in shape, such that it is provided with a pair of long opposing sides 15 and 16 and a pair of short opposing sides 17 and 18 (FIG. 1). Of course, pallet 10 may be of any shape and still be within the scope of the invention, with reference being made to a generally rectangular shape for ease of this discussion.

Pallet 10 is provided with a plurality upwardly opening, downwardly extending feet or legs, such as corner legs 20. Depending on the size of pallet 10, long sides 15 and 16 may be provided with intermediate legs 21. Similarly, sides 16 and 17 may also be provided with intermediate legs 22 and often a central or interior leg 23 is desirable.

Thus, while the number, configuration and location of legs 20, 21, 22 and 23 are not necessarily limitations of the invention, it is preferred that they be configured such that a second pallet 10 may be placed onto a first pallet 10 in a leg-nesting manner. Furthermore, it is preferred that when pallet 10 is placed upon a support surface, legs 20, 21, 22 and 23 will raise body 11 above the support surface. As such, a forklift or the like (not shown) may be placed underneath pallet 10 to lift and transport it as desired. In addition, by being raised upon legs 20, 21, 22 and 23, the area beneath body 11 is open, and a circulation of air may be allowed to flow therethrough.

Sides 15, 16, 17 and 18 of pallet 10 are provided with a peripheral edge surface 24 (FIG. 1A), which may be a built-up area, a fold, a bead of the like to provide edge strength to pallet 10. A plurality of edge grooves 25 may be provided adjacent to edge surface 24, in order to further provide edge strength. Edge grooves 25 are thus a series of juxtaposed grooves, separated by a non-grooved portion 26 of upper surface 12 of body 11, and generally parallel along their longitudinal dimension to their adjacent peripheral edge surface 24. Thus, grooves 25 provide both lateral and longitudinal strengthening characteristics to body 11. A more continuous corner groove 27 may be provided between edge surface 24 and a given corner leg 20. These grooves, as that term is used herein, are deformations integrally formed in pallet 10, and correspond to a ridge formed on the opposite side of pallet 10.

Figure 5:
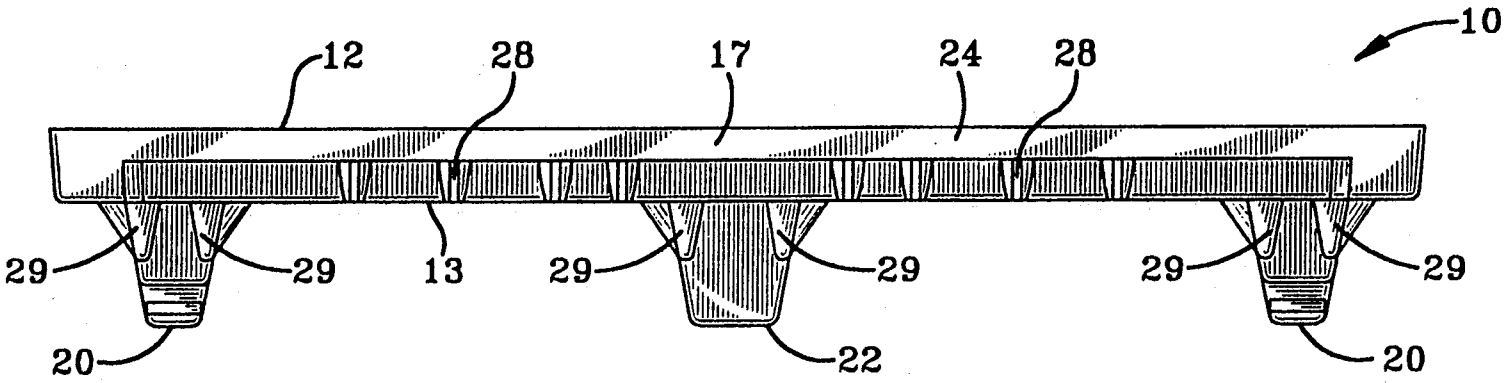
FIG. 5 is a side elevational view taken along line 5—5 of FIG. 1.
Figure 6:
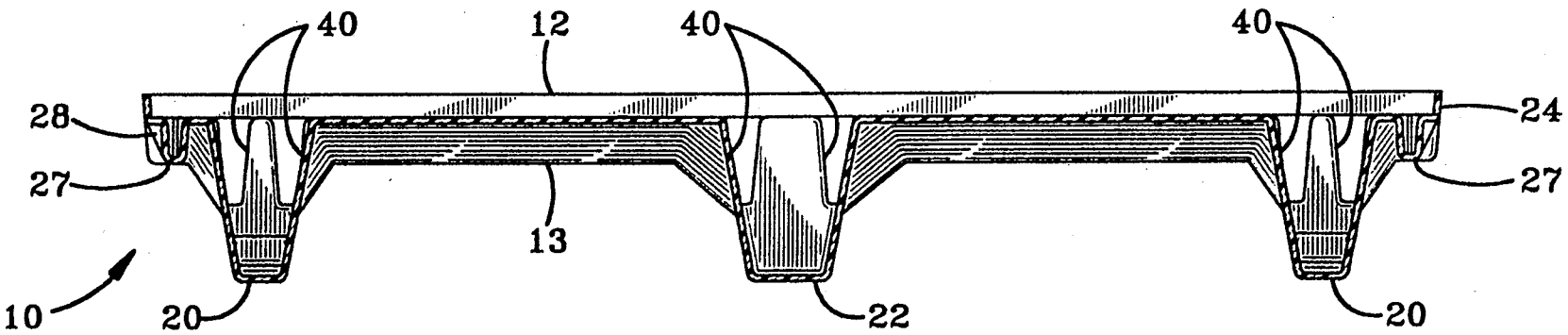
FIG. 6 is a sectional view taken substantially along line 6—6 of FIG. 1.
Figure 7:
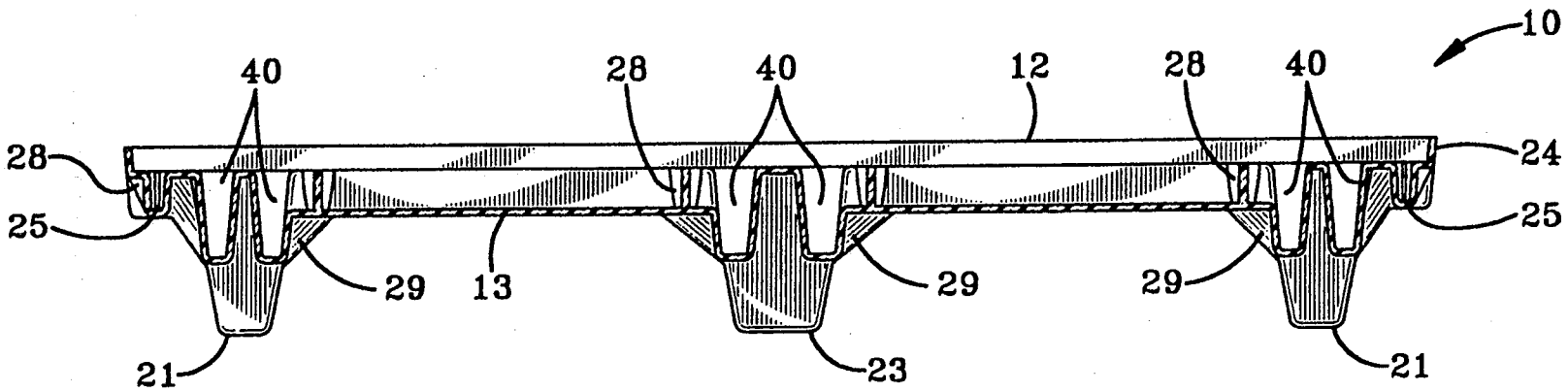
FIG. 7 is a sectional view taken substantially along line 7—7 of FIG. 1.
Figure 8:
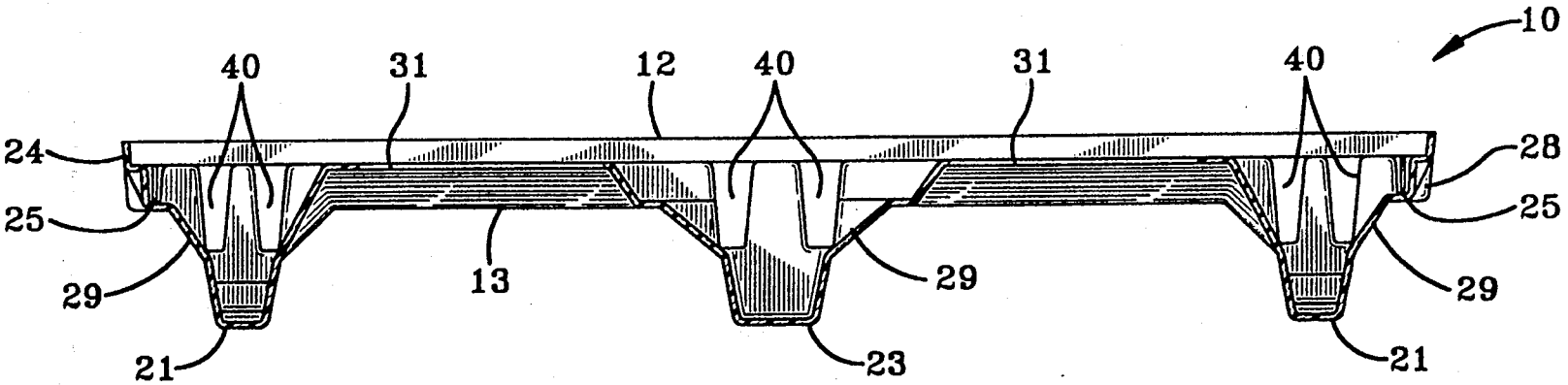
FIG 8 is a sectional view taken substantially along line 8—8 FIG. 1.

In order to support peripheral edge 24, and to help prevent bending thereof, strengthening webs 28 (FIGS. 2 and 5) may be provided. One preferred configuration of webs 28 extend between peripheral edge 24 and each of legs 20, 21 (FIG. 2) and 22 (FIG. 5). Also, legs 20, 21, 22 and 23 may be provided with strengthening ribs 29, to support the legs and increase the load bearing capacity of pallet 10.

A plurality of ventilation apertures 30 extend through body 11 of pallet 10, thus providing an opening in both upper and lower surfaces 12 and 13. One preferred configuration, when employing a rectangular pallet 10 as depicted in the drawings, includes four ventilation apertures 30, generally positioned adjacent to the four corners of pallet 10, and two interior ventilation apertures 31, each positioned in alignment between two ventilation apertures 30.

When material, which may or may not be contained in boxes 14, is placed onto pallet 10, air may circulate through ventilation apertures 30 and engage, contact or otherwise flow about the material. This is especially beneficial when pallet 10 is employed to store organic matter, as was discussed hereinabove.

An aperture in a pallet will naturally have a tendency to weaken the pallet, as is known in the art. To compensate for such weakening, the present invention makes use of a unique arrangement of strengthening grooves and ridges juxtaposed to ventilation apertures 30, as will now be described. For the ease of the following discussion, the invention will be described with respect to grooves in upper surface 12, it being understood that in single-ply construction, there will normally be corresponding ridges in lower surface 13.

As depicted in the drawings, ventilation apertures 30 are preferably rectangular in shape. Of course, any configuration which accomplishes the objects of the invention is within the scope of the invention. There is provided adjacent to each ventilation aperture 30, a plurality of lateral grooves 32 which extend in a direction generally lateral to long sides 15 and 16 and substantially parallel to short sides 17 and 18 of pallet 10.

Preferably, lateral grooves 32 are arranged in a regularly spaced parallel relation with each other and also parallel to the longitudinal dimension of each generally rectangular ventilation aperture 30. While one lateral groove 32 would provide strength to the otherwise aperture-weakened areas of pallet 10, it is preferred to provide a plurality of lateral grooves 32. For example, as shown in the drawings (FIG. 1), three parallel, lateral grooves 32 are positioned in a longitudinally parallel relation between each ventilation aperture 30 and the respective pallet short sides 17 and 18. Similarly, there are seven lateral grooves 32 positioned between each ventilation aperture 30 and interior ventilation apertures 31.

Pallet 10 is also provided with a plurality of regularly spaced parallel grooves 40, which extend in a longitudinal direction, that; is, substantially parallel to long sides 15 and 16 of pallet 10. Furthermore, a line parallel to longitudinal grooves 40 would be generally perpendicular to a line parallel to the longitudinal dimension of each ventilation aperture 30 and 31. Non-groove areas, generally designated by the numeral 41 in the drawings, between adjacent longitudinal grooves 40 are portions of upper surface 12.

One preferred configuration for the spacing of longitudinal grooves 40 is to provide six groups of two adjacent grooves, arranged in two columns of three such groups, a column being generally parallel to the short sides 17 and 18 of pallet 10. Thus, two such grooves 40 are provided in close proximity, with a non-grooved portion 41 of upper surface 12 therebetween. It is still more preferred that a set of two longitudinal grooves in close parallel proximity to each other extend longitudinally generally between each corner leg 20 and long side intermediate legs 21, and between short side intermediate legs 22 and interior leg 23 (FIG. 1).

As will be appreciated by one skilled in the art, lateral grooves 32 serve to strengthen pallet 10, such that bending of upper and lower surfaces 12 and 13 in a direction parallel to a line generally perpendicular to short side 17 and 18, is effectively deterred. Similarly, longitudinal grooves 40 serve to strengthen pallet 10, such that bending of upper .and lower surfaces 12 and 13 in a direction parallel to a line generally perpendicular to long sides 15 and 16, is also effectively deterred. Lateral grooves 32 and longitudinal grooves 40 are preferably arranged in body 11 such that they are regularly spaced from each other and are adjacent to ventilation apertures 30 and 31, that is, they are placed in a position generally next to ventilation apertures 30 and 31, although certain of grooves 32 and 40 may be closer in proximity than other such grooves.

It is to be appreciated that pallet 10 may be provided with strengthening grooves other than grooves 32 and 40, and that none of the grooves need necessarily be arranged so as to be parallel to pallet sides 17 and 18 or 15 and 16. Grooves at various angles to each other and sides 15, 16, 17 and 18 are within the scope of the invention.

Figure 1A:
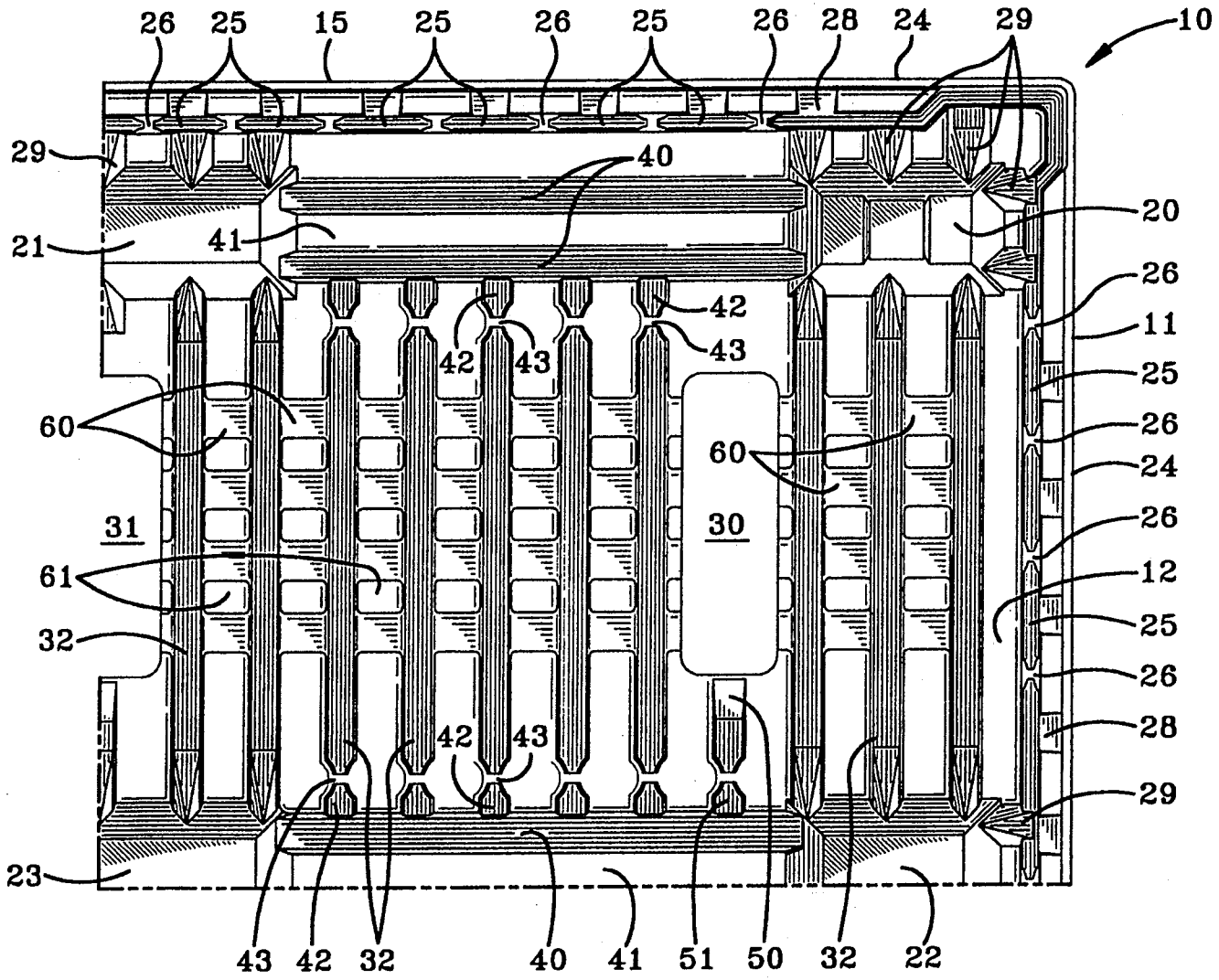
FIG. 1A is an enlarged, top plan view of a quarter portion of the pallet of FIG. 1.

Any of the grooves 32 or 40 may also be interrupted such that there is a portion of upper surface 11 between a given groove and a juxtaposed extension thereof. For example, as shown in FIG. 1A, certain of the lateral grooves 32 between ventilation aperture 30 and interior ventilation aperture 31 are interrupted and juxtaposed to a termination groove portion 42, with an intervening area of surface 12, designated by the numeral 43, therebetween. Termination groove portions 42 may be integrally connected to juxtaposed longitudinal grooves 40, as depicted in the drawings. The regular alternating nature of grooves and surface portions serves to further increase the overall strength of pallet 10.

A shorter length and interspaced longitudinal grooves, such as designated by the numeral 50 in the attached drawings, and interspaced termination groove portions 51, may be provided to maximize the strength of pallet 10, especially when juxtaposed to ventilation apertures 30 and 31, as depicted in the drawings.

It has been found that by providing the unique structure and arrangement of grooves about pallet 10, as discussed hereinabove, that pallet 10 maintains an inherent strength integrity.

The present invention thus provides a load bearing apparatus for storage and shipment operations of materials which may require a circular:ion of air thereabout during such operations. Such is shown in FIGS. 9 and 10 whereby pallet 10 is shown as carrying a plurality of boxes 14 having at least two opposing walls 52, and in actuality, six walls 52 as is conventional with a box. Each box 14 is provided with at least two opposing circulation apertures 53 in two opposing walls 52 thereof (FIG. 10). By placing box 14 upon pallet 10 in a manner such that a circulation aperture 53 is placed in an at least partially overlapping manner to a ventilation aperture 30 or 31 (FIG. 9), a continuous circulation of air is able to pass through both circulation container apertures 53 and ventilation apertures 30 or 31. Materials within boxes 14 may thus be exposed to such a circulation, for the beneficial purposes as discussed hereinabove.

Although any shape and number of opposing container apertures 53 are within the scope of the invention, it is evident that they should be provided in a configuration generally corresponding to that of ventilation apertures 30 or 31 in pallet 10. Furthermore, to be opposing, it is merely necessary that at least one aperture 53 be located somewhere within each of two opposing walls 52 of a given box 14. It is preferred however, that each container aperture 53 be positioned in its respective wall 52, at a similar position respective the opposing container aperture 53.

It will be understood that a plurality of boxes 14 may be stacked one on top of the next upon a pallet 10 (FIG. 10). Container apertures 53 will generally align with ventilation apertures 30 and 31. However, there may be occasions when employing pallet 10, when a ventilation aperture 30 or 31 will not align with any portion of a container aperture 53 of a box 14 stacked thereon. This may occur in any number of situations, such as when box 14 is improperly sized or manufactured or is damaged or the like. At such times, circulation of air would be impeded and would not pass boxes 14 from below pallet 10. Such an occurrence may be avoided according to the invention by the presence of air circulation grooves 60, which will now be discussed.

Air circulation grooves 60 are provided to intersect and extend between adjacent ventilation apertures 30 and 31, and to intersect lateral grooves 32. Thus, no matter what the position of box 14 upon pallet 10, it is substantially assured that some portion of circulation aperture 53 of a given box 14 will be positioned on top of at least one air circulation groove 60, and thereby be connected to a ventilation aperture 30 or 31. Hence, continued circulation of air is maintained because an air passage is effectively formed between lateral groove 32 and ventilation aperture 30 and 31. Ventilation apertures 30 and 31 may be connected via air circulation grooves 60 to each other and lateral grooves 32, or even longitudinal grooves 40 (not shown). Non-grooved portion of surface 12, designated by the numeral 61 in the drawings, are located between air circulation grooves 60.

It is a common practice in the pallet art, after the material to be stored is placed thereon, to cover the materials with a netting or the like, and then to tie the netting to the pallet. Pallet 10 is configured to make such a procedure more efficient. To this end, at least some of the legs of pallet 10 may be configured to accept a tie-down such as a rope, netting or the like (not shown). For example, legs 20 (FIG. 2) may be provided with an indented surface 70, such that a rope or netting maybe wrapped around indented surface 70 to provide a more secure knotting surface therefor.

Based upon the foregoing disclosure, it should now be apparent that the use of the pallet and pallet apparatus described herein will carry out the objects set forth hereinabove. It is, therefore, to be understood that any variations evident fall within the scope of the claimed invention and thus, the selection of specific components or arrangements thereof can be determined without departing from the spirit of the invention herein disclosed and described. Thus, the scope of the invention shall include all modifications and variations that may fall within the scope of the attached claims.

We claim:

1. A pallet for use in bearing a load from material requiring a circulation of air during storage or shipment thereof, comprising a plastic body having a plurality of ventilation apertures therethrough, a plurality of strengthening grooves integrally formed in said body and adjacent to said ventilation apertures: and a plurality of downwardly extending legs, at least one said leg being integrally provided with a tie-down means for tying a covering to the pallet, wherein said tie-down means includes an indented surface integrally formed in said at least one said leg.

2. A pallet as set forth in claim 1, wherein said body includes an upper surface and a lower surface, and a peripheral edge defining a first pair of opposing, parallel sides and a second pair of opposing parallel sides.

3. A pallet as set forth in claim 2, wherein said strengthening grooves include a plurality of grooves arranged in a spaced parallel relation, and generally parallel to one of said first or second opposing, parallel sides.

4. A pallet as set forth in claim 3, further comprising a second plurality of grooves arranged in a spaced parallel relation, and generally parallel to the other of said first or second opposing, parallel sides.

5. A pallet as set forth in claim 3, further comprising an air circulation groove intersecting at least one of said strengthening grooves and at least one of said ventilation apertures, such that an air passage is formed between said at least one strengthening groove and said at least one of said ventilation apertures via said air circulation groove.

6. A pallet, as set forth in claim 5, wherein a plurality of said air circulation grooves extend between and intersect at least two of said ventilation apertures and a plurality of said strengthening grooves.

* * * * *